US008931923B2

(12) United States Patent
Liu et al.

(10) Patent No.: US 8,931,923 B2
(45) Date of Patent: Jan. 13, 2015

(54) LED DOWN LAMP WITH REPLACEABLE COLOR TEMPERATURE FILTER

(71) Applicant: General Luminaire Co., Ltd., Taipei (TW)

(72) Inventors: Huai-Ling Liu, Shanghai (CN); Yung-Hong Wang, Taipei (TW)

( * ) Notice: Subject to any disclaimer, the term of this patent is extended or adjusted under 35 U.S.C. 154(b) by 126 days.

(21) Appl. No.: 13/678,566

(22) Filed: Nov. 16, 2012

(65) Prior Publication Data

US 2014/0140053 A1 May 22, 2014

(51) Int. Cl.

| | |
|---|---|
| ***F21V 9/10*** | (2006.01) |
| ***F21V 29/00*** | (2006.01) |
| ***F21S 8/02*** | (2006.01) |
| ***F21S 10/02*** | (2006.01) |
| ***F21V 15/01*** | (2006.01) |
| ***F21V 9/08*** | (2006.01) |
| ***F21V 17/00*** | (2006.01) |
| ***F21V 17/10*** | (2006.01) |
| *F21W 131/406* | (2006.01) |
| *F21Y 101/02* | (2006.01) |

(52) U.S. Cl.

CPC . *F21V 29/22* (2013.01); *F21S 8/02* (2013.01); *F21V 9/10* (2013.01); *F21S 10/02* (2013.01); *F21V 15/01* (2013.01); *F21V 29/2231* (2013.01); *F21V 9/08* (2013.01); *F21V 17/002* (2013.01); *F21V 17/10* (2013.01); *F21W 2131/406* (2013.01); *F21Y 2101/02* (2013.01)

USPC ..... 362/293; 362/656; 362/647

(58) Field of Classification Search

CPC .... F21W 2131/406; F21V 9/10; F21V 15/01; F21S 10/02; F21S 8/02; F21Y 2101/02

USPC ..... 362/293, 656, 647, 655, 368

See application file for complete search history.

(56) References Cited

U.S. PATENT DOCUMENTS

| | | | | |
|---|---|---|---|---|
| 6,612,720 | B1 * | 9/2003 | Beadle | 362/287 |
| 7,048,408 | B2 * | 5/2006 | Dallas et al. | 362/202 |
| 2004/0264193 | A1 * | 12/2004 | Okumura | 362/276 |
| 2009/0296403 | A1 * | 12/2009 | Zhang et al. | 362/294 |
| 2010/0315823 | A1 * | 12/2010 | Lin et al. | 362/368 |

* cited by examiner

*Primary Examiner* — Peggy Neils

(57) ABSTRACT

A light emitting diode (LED) down lamp with a replaceable color temperature filter uses a plurality of blue LEDs as a light source and includes a color temperature filter and a fixing ring. The color temperature filter is installed across the top of the down lamp to apart cover the LEDs with a distance, and then fixed by the fixing ring. Therefore, the color temperature filter can be replaced flexibly with other one in different color temperature one by removing or assembling the fixing ring to change the light projected from the LEDs into different color tone for fitting studio, stage or indoor space applications. Such lamp achieves the effects of enhancing the illumination function of a single down lamp, reducing the inventory cost and improving the practicality.

6 Claims, 4 Drawing Sheets

LED DOWN LAMP WITH REPLACEABLE COLOR TEMPERATURE FILTER

BACKGROUND OF THE INVENTION

1. Field of the Invention

The present invention relates to the technical field of down lamps, and more particularly to the LED down lamp with a replaceable color temperature filter capable of achieving the effects of enhancing the applicability of the down lamp and assisting wholesales of illumination equipment to reduce inventory.

2. Description of the Related Art

After light-Emitting Diodes (LED) hit the illumination market with the features of low power consumption and high performance, one of the major research and development issues for related manufacturers is to control the luminance, brightness and service life of LED illumination equipments, and the LED illumination equipments are generally divided into two main types, respectively: a detachable lamp with a replaceable LED bulb or tube and an integrally formed lamp integrated with an LED light source, a lamp holder and a heat sink (might be directly combined with the lamp holder). The detachable lamp allows users to change flexibly various LED light source in different color temperatures to provide a wider scope of applicability and a better economic benefit of replacing damaged LED light sources. However, such LED lamp has a poor heat dissipation effect, thus causing a low performance of the LED lamp as well as affecting the brightness of the emitted light, the stability of the illumination and the service life of the product. On the other hand, the integrally formed LED lamp has a better heat dissipation effect, but the finished goods do not allow users to change the light color flexibly. For example, a down lamp generally comes with a color temperature filter attached onto a light projecting surface or comes with a given color temperature LED light source, so that the lamp projects light and four single color tone only, thus limiting the scope of applicability and requiring a large inventory.

To meet the requirements of the color tone of illuminations in different occasions, the conventional LED lamps adopt a control circuit to control the LED light source of various color lights and adjust the light intensity of the LED light source of various different color lights in order to change the color tone projected from the lamps. However, such method incurs a very complicated circuit and a very high cost. Alternatively, Yttrium Aluminum Garnet (YAG) fluorescent powder is coated onto the blue LED light source, wherein the fluorescent powder produces a mixed yellow and green light of 500~560 nm to produce a white light. However, such method still cannot overcomes the drawbacks including the need of changing the color temperature of an integrally formed lamp such as the down lamp, the low light uniformity, and the easily deviated color temperature that may affect the consistence of the color tone and the color rendering property.

In view of the aforementioned drawbacks, it is a subject for the present invention to improve the down lamp structure to allow users to replace the color temperature filter on their own for flexibly changing the projected color tone, further reducing the inventory cost of the lamps.

SUMMARY OF THE INVENTION

Therefore, it is a primary objective of the present invention to overcome the problems of the prior art by providing an LED down lamp with a replaceable color temperature filter, wherein a detachable ring cover is provided for fixing and covering various color temperature filters onto the down lamp to achieve the effects of movably and flexibly changing the light color and enhancing the convenience and multi-functionality of the lamp.

To achieve the aforementioned objective, the present invention provides a LED down lamp with a replaceable color temperature filter applicable for a studio, a stage or an indoor space and comprising a base and a light emitting module having a plurality of LEDs cased in the base, is characterized in that the LED down lamp with a replaceable color temperature filter is provided with a color temperature filter and a fixing ring, and the fixing ring is substantially a hollow cover in a design corresponding to the base and includes a plurality of protrusions disposed around the fixing ring to form a first notch and a second notch; the first notch is provided for embedding and coupling the periphery of the top of the base, and the second notch is provided for containing the color temperature filter, so that the color temperature filter is fixed and spanned across the top of the base to apart cover the light emitting module with a distance for changing the light projected from the LEDs into different color tone.

Wherein, the LED is a blue light source of 440 nm~460 nm, the color temperature filter has a color temperature selected from the collection of 2700K, 3000K, 3500K, 4000K, 4500K, 5000K, 5700K and 6500K, and the distance falls within a range of 5 mm~20 mm.

To facilitate the removal and enhance the practicality of the lamp, the fixing ring is secured to the base through at least one locking element. Alternatively, the base has an external thread formed on an outer wall of the top of the base, and an internal thread formed on an inner wall of the fixing ring for engaging with the external thread to secure the base. Even, the base has a plurality of snap slots formed around the periphery of the top of the base, and a plurality of snap parts formed corresponding to the snap slots and disposed around the periphery of the fixing ring for engaging with the snap slots to secure the base. For example, if the fixing ring has three protrusion and three snap parts, the protrusions are arranged equidistantly with one another, and each snap part is arranged on a side of an interval between the protrusions, so that the protrusions and the snap parts are arranged alternately with one another. After the fixing ring and the base are engaged with each other, the fixing ring and the base can be secured by rotating the fixing ring in a direction with respect to the base.

In addition, the side edges and the top of the fixing ring are wavy surfaces to increase the surface area and expedite the heat dissipation effect.

In summation of the description above, the structure of the present invention that combines the fixing ring with the base allows the same down lamp to project light source in different color tone according to actual requirements. Compared with the conventional structure that mounts the color temperature filter onto the down lamp, the present invention provides better practicality and more functions, and facilitates lamp wholesalers and users to reduce inventory and save cost.

DETAILED DESCRIPTION OF THE PREFERRED EMBODIMENTS

The technical contents of the present invention will become apparent with the detailed description of preferred embodiments and the illustration of related drawings as follows.

Figure 1:
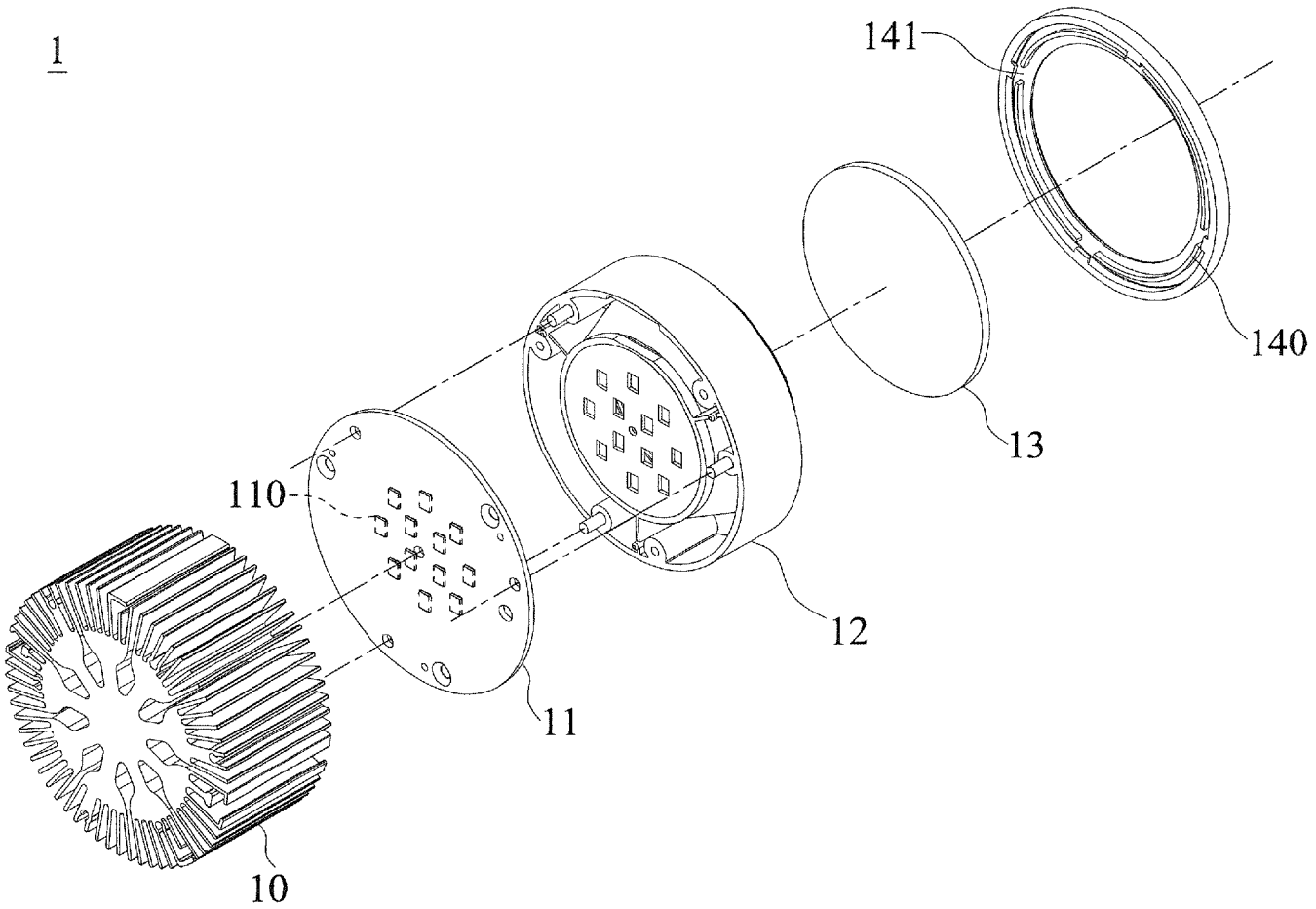
FIG. 1 is an exploded view in one aspect in accordance with the first preferred embodiment of the present invention.

With reference to FIG. 1 for an exploded view in one aspect in accordance with a first preferred embodiment of the present invention, the down lamp structure 1 with the feature of changing the color of the light easily is applicable in a studio, on a stage or in an indoor space and achieves the effects of reducing the inventory, lowering the cost, and saving natural resources. The down lamp structure 1 comprises a heat sink 10, a light emitting module 11, a base 12, a color temperature filter 13 and a fixing ring 14, wherein the light emitting module 11 is installed onto the heat sink 10 and cased into the base 12 and includes a plurality of LEDs 110. The fixing ring 14 is designed as a hollow cover in a design corresponding to the base 12 and has a plurality of protrusions 140 disposed around the periphery of the fixing ring 14 to form a first notch and a second notch. The first notch is provided for embedding and coupling to the periphery of the top of the base 12, and the second notch is provided for containing the color temperature filter 13, so that the color temperature filter 13 is fixed and spanned across the top of the base 12 and apart covers the light emitting module 11 with a distance, and the color tone of the light of the LEDs 110 can be changed flexibly.

Figure 2:
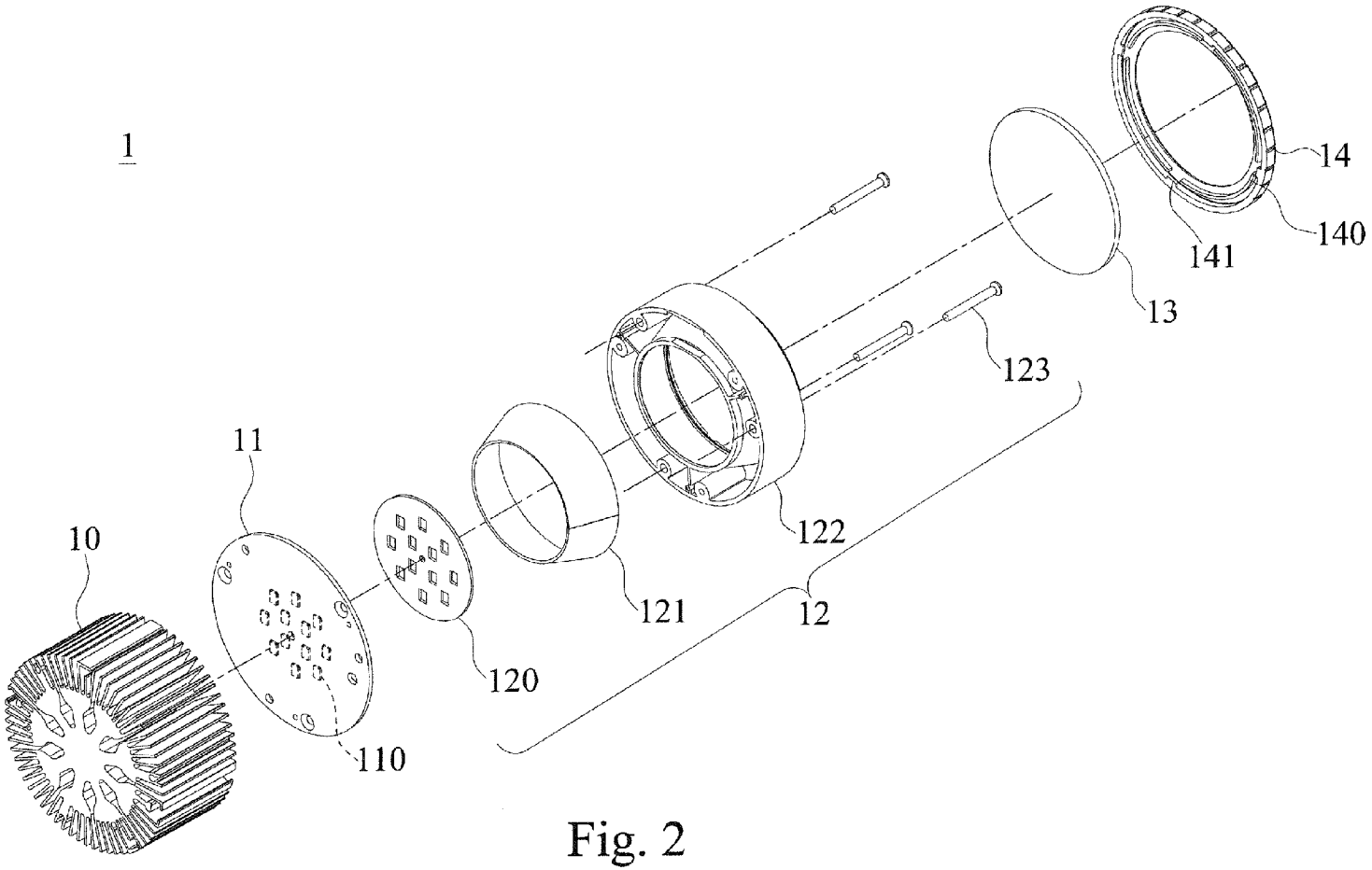
FIG. 2 is an exploded view in one aspect in accordance with the second preferred embodiment of the present invention.
Figure 3:
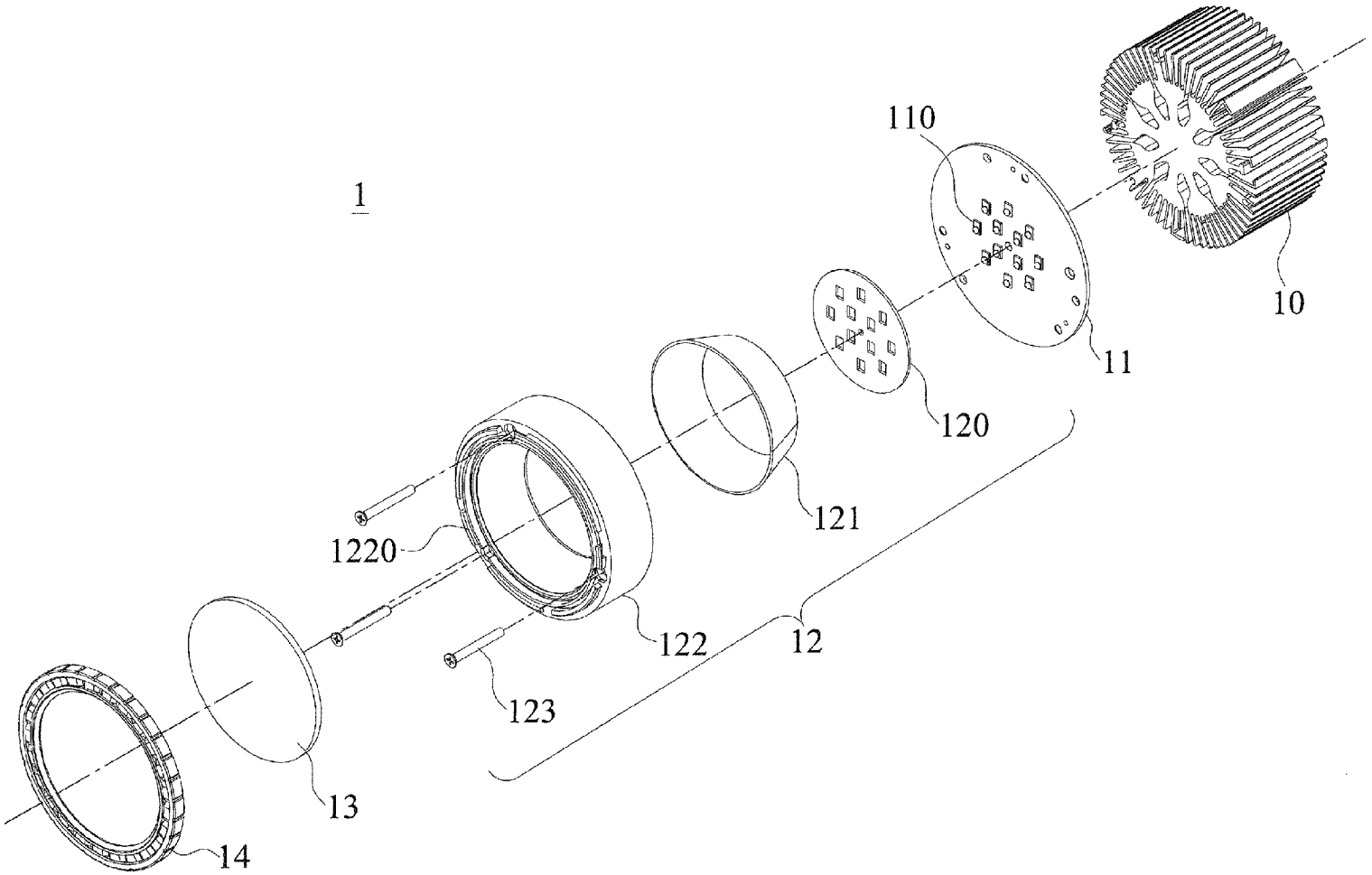
FIG. 3 is an exploded view in another aspect in accordance with the second preferred embodiment of the present invention.
Figure 4:
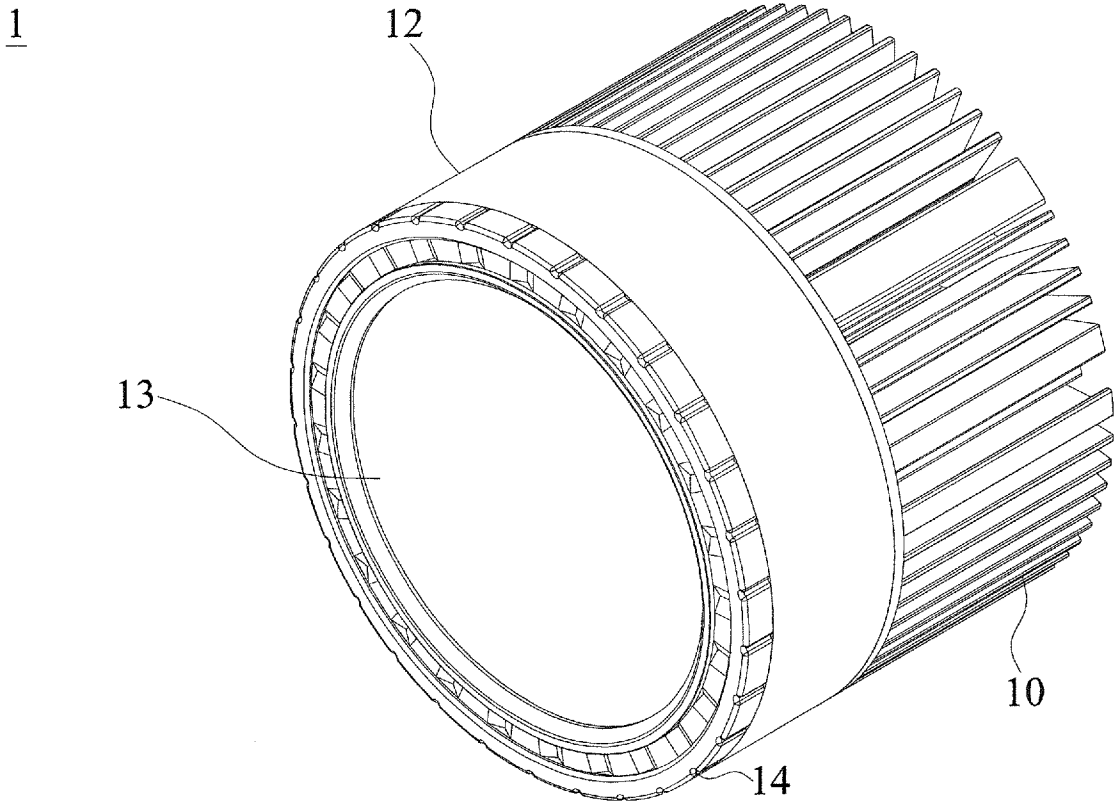
FIG. 4 is a perspective view in accordance with the second preferred embodiment of the present invention.

In FIGS. 2 to 4 for exploded views and a perspective view in accordance with a second preferred embodiment of the present invention respectively, each LED 110 is a blue light source of 440 nm~460 nm, and the color temperature filter 13 is in a color temperature of 2700K, 3000K, 3500K, 4000K, 4500K, 5000K, 5700K or 6500K, thus replacing the color temperature filter 13 allows the down lamp structure 1 to project a color light such as a white, very cool purple white or very warm yellowish orange white color freely to meet the requirements of the actual shooting scene.

The base 12 has a bottom plate 120, a reflecting cup 121 with high reflectivity, and a mount ring 122, wherein the bottom plate 120 is formed a plurality of holes thereon corresponding to the installation positions of LEDs 110 for containing the LEDs 110 while the bottom plate 120 is attached with the light emitting module 11. The mount ring 122 is a hollow cylinder containing the reflecting cup 121 therein, and the hollow cylinder has a height approximately equal to 5 mm~15 mm, so that the distance between the color temperature filter 13 and the light emitting module 11 is equal to 5 mm~15 mm. The reflecting cup 121 is a hollow tapered inverted-cone with the top coupled onto an inner wall of the mount ring 122 and the bottom coupled to the periphery of the bottom plate 120, so that after the base 12 is secured to the light emitting module 11 by three screws 123, the light source emitted from the LEDs 110 can be diffused better to improve the uniformity of the light.

In this preferred embodiment, the mount ring 122 has a plurality of snap slots 1220 formed around the periphery of the top of the mount ring 122, and corresponding to the design of the base 12, the fixing ring 14 has a plurality of snap parts 141 disposed on the periphery around. For example, the fixing ring 14 has three protrusions 140 and three snap parts 141, and the protrusions 140 are arranged with an interval apart from one another, and each snap part 141 is disposed on a side of the interval between the protrusions 140, so that the protrusions 140 and the snap parts 141 can be arranged alternately with one another. After the fixing ring 14 and the base 12 engaged with each other and rotated in a direction with respect to one another, the snap parts 141 engaged the corresponding snap slots 1220 respectively to assemble said fixing ring 14 and said base 12. Similarly, the fixing ring 14 and the base 12 can be separated from one other easily by rotating them in an opposite direction to facilitate a change of the color temperature filter 13. To have a design corresponding to the base 12, the fixing ring 14 can be secured to the base 12 through at least one locking element (not shown in the figure). Alternatively, the base 12 has an external thread (not shown in the figure) formed on an outer wall of the top of the base, and the fixing ring 14 has an a internal thread formed on an inner wall (not shown in the figure) for engaging with the external thread to secure the base 12. It is noteworthy that the side edges and the top of the fixing ring 14 are wavy surfaces to increase the surface area and expedite the heat dissipation effect.

What is claimed is:

1. A light emitting diode (LED) down lamp, applicable for a studio, a stage or an indoor space and comprising a base and a light emitting module having a plurality of LEDs cased in the base, is characterized in that the LED down lamp is provided with a color temperature filter and a fixing ring, and the fixing ring is substantially a hollow cover in a design corresponding to the base and includes three protrusions and three snap parts disposed around the fixing ring to form a first notch and a second notch; the first notch is provided for embedding and coupling the periphery of the top of the base, and the second notch is provided for containing the color temperature filter, so that the color temperature filter is fixed and spanned across the top of the base to cover the light emitting module for changing the light projected from the LEDs into different color tone, wherein the protrusions are arranged equidistantly with one another, and each snap part is arranged on a side of an interval between the protrusions, so that the protrusions and the snap parts are arranged alternately with one another, wherein the base has a plurality of snap slots formed around the periphery of the top of the base, for engaging with the snap parts to secure the base.

2. The LED down lamp according to claim 1, wherein the color temperature filter has a color temperature selected from the collection of 2700K, 3000K, 3500K, 4000K, 4500K, 5000K, 5700K and 6500K.

3. The LED down lamp according to claim 2, wherein the LED is a blue light source of 440 nm~460 nm.

4. The LED down lamp according to claim 3, wherein the distance falls within a range of 5 mm~20 mm.

5. The LED down lamp according to claim 4, wherein the fixing ring is secured to the base through at least one locking element.

6. The LED down lamp according to claim 4, wherein a side edge and a top of the fixing ring are wavy surfaces.

* * * * *